US012774125B2

(12) United States Patent
Grindstaff et al.

(10) Patent No.: US 12,774,125 B2
(45) Date of Patent: Oct. 27, 2026

(54) AUTOMATED DECANTING APPARATUS, A SYSTEM INCLUDING THE APPARATUS, AND A METHOD OF AUTOMATIC DECANTING USING A PROGRAMMABLE MECHANICAL DEVICE

(71) Applicant: Cornerstone Automation Systems, LLC, Frisco, TX (US)

(72) Inventors: Jeffrey Grindstaff, Collinsville, TX (US); Benjamin William O'Brien, Omaha, NE (US); Jonathan Hogan Webb, Allen, TX (US)

(73) Assignee: Cornerstone Automation Systems, LLC, Frisco, TX (US)

( * ) Notice: Subject to any disclaimer, the term of this patent is extended or adjusted under 35 U.S.C. 154(b) by 0 days.

(21) Appl. No.: 18/605,435

(22) Filed: Mar. 14, 2024

(65) Prior Publication Data

US 2024/0308715 A1 Sep. 19, 2024

Related U.S. Application Data

(60) Provisional application No. 63/490,639, filed on Mar. 16, 2023.

(51) Int. Cl.
*B65B 69/00* (2006.01)

(52) U.S. Cl.
CPC ..... *B65B 69/0033* (2013.01); *B65B 69/005* (2013.01)

(58) Field of Classification Search
CPC . B65B 69/0033; B65B 69/005; B65G 57/301; B65G 61/00
See application file for complete search history.

(56) References Cited

U.S. PATENT DOCUMENTS 3,482,718 A * 12/1969 Moriarty ..... B65B 69/0008 414/412
3,937,342 A * 2/1976 Ittner ..... B65B 43/39 198/457.05
4,548,539 A * 10/1985 Nagashino ..... B65B 69/00 414/412
7,720,567 B2 * 5/2010 Doke ..... B25J 11/0055 700/230
10,955,826 B2 * 3/2021 Edwards ..... B65B 69/00
11,161,640 B2 * 11/2021 Nishigaito ..... B65B 69/0025
2004/0250670 A1 * 12/2004 Porter ..... B65B 69/0025 83/401
2013/0125517 A1 * 5/2013 Gomi ..... B65B 69/0033 53/381.1

(Continued)

*Primary Examiner* — Andrew M Tecco
*Assistant Examiner* — Nicholas E Igbokwe

(57) ABSTRACT

The disclosure provides an automated process, apparatus and system for decanting containers wherein the form of the container is altered during the decanting process. The decanting includes altering the form of the containers for the separation or removal of the product from the containers. The altering can include a pushing motion, a pulling motion, or both on one or more sides of the containers. In one example, a method of automatically decanting products from containers includes: (1) opening a portion of a container, (2) lifting and rotating the container using a robotic depositing device, and (3) separating product from the container after the lifting and rotating by altering a form of the container using the robotic depositing device.

22 Claims, 9 Drawing Sheets

(56) References Cited

U.S. PATENT DOCUMENTS

| | | | | |
|---|---|---|---|---|
| 2020/0306973 | A1* | 10/2020 | Edwards | B25J 9/1694 |
| 2020/0316787 | A1* | 10/2020 | Fujihara | B25J 15/0014 |
| 2021/0130025 | A1* | 5/2021 | Schaafsma | B26D 1/01 |
| 2022/0111538 | A1* | 4/2022 | Tsujimori | B25J 15/0071 |
| 2022/0111992 | A1* | 4/2022 | Svoldgaard | B65B 69/00 |
| 2022/0219857 | A1* | 7/2022 | Tsujimori | B25J 15/009 |
| 2023/0219708 | A1* | 7/2023 | Mell | B65B 69/0033 414/810 |

* cited by examiner

AUTOMATED DECANTING APPARATUS, A SYSTEM INCLUDING THE APPARATUS, AND A METHOD OF AUTOMATIC DECANTING USING A PROGRAMMABLE MECHANICAL DEVICE

CROSS-REFERENCE TO RELATED APPLICATION

This application claims the benefit of U.S. Provisional Application Ser. No. 63/490,639, filed by Jeffrey Grindstaff, et al. on Mar. 16, 2023, entitled "AUTOMATED DECANTING APPARATUS, A SYSTEM INCLUDING THE APPARATUS, AND A METHOD OF AUTOMATIC DECANTING USING A PROGRAMMABLE MECHANICAL DEVICE," commonly assigned with this application and incorporated herein by reference in its entirety.

TECHNICAL FIELD

This application is directed to decanting products and, more specifically, to automatically decanting products.

BACKGROUND

Boxes, cartons, or other types of containers are used to safely package products for shipping. In warehouses or fulfillments centers products are often received in one type of container, removed, and then placed in other containers for storage. The storage containers can then be placed on racks for later retrieval of the products. The storage containers can be part of an automated storage and retrieval system (ASRS). Whether a traditional storage system or an ASRS, products may have to be removed from their shipping containers and placed in storage containers. Opening, unpacking, and transferring the products from an enclosed container, such as a shipping container, to another container for storage is a time consuming process. With the growth of online retail, the time required to unpack or decant products has become an even greater time consuming process as fulfillment centers receive and store products for filling multiple shipping orders on a daily basis. As such, an improved way to decant products would be advantageous.

SUMMARY

In one aspect, the disclosure provides an automated decanter. In one example, the automated decanter includes: (1) lifting arms configured to separate one or more products from at least one container by altering a form of the at least one container.

In another aspect, the disclosure provides a product processing system. In one example, the product processing system includes: (1) an automated transport system and (2) an automated decanter that receives containers from the automated transport system and has (2A) a cutting tool configured to cut the containers along a cut line proximate a top of the containers; and (2B) a depositing device having lifting arms configured to separate one or more products from at least one container by altering a form of the at least one container.

In yet another aspect, a method of automatically decanting products from containers is disclosed. In one example, the method includes: (1) opening a portion of a container, (2) lifting and rotating the container using a robotic depositing device, and (3) separating product from the container after the lifting and rotating by altering a form of the container using the robotic depositing device.

BRIEF DESCRIPTION

The foregoing summary, preferred examples, and other aspects of the subject matter of the present disclosure will be best understood with reference to the detailed description of specific examples, which follows, when read in conjunction with the accompanying drawings, in which.

DETAILED DESCRIPTION

Figure 1:
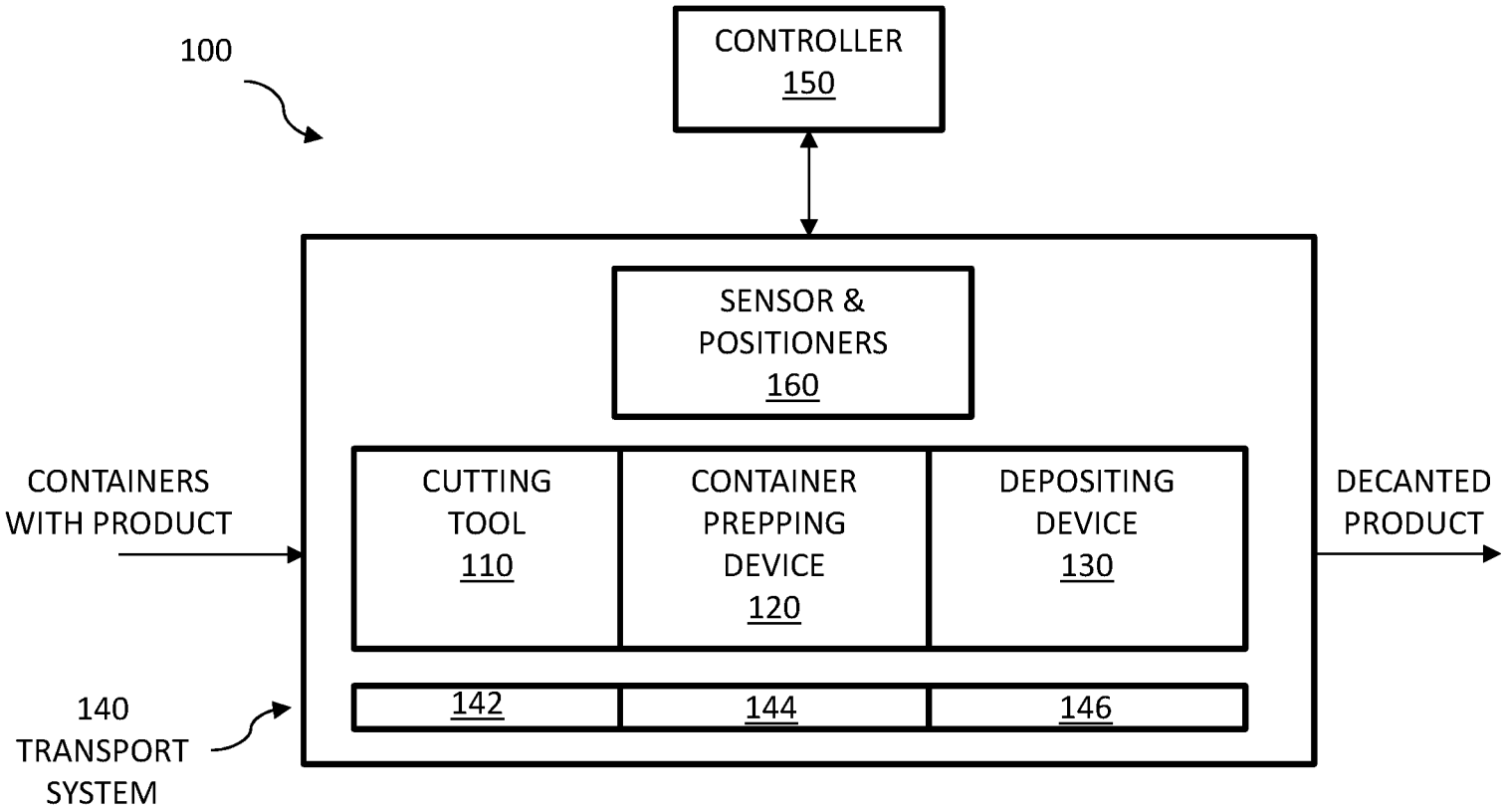
FIG. 1 illustrates a block diagram of an example of an automated decanting system constructed according to the principles of the disclosure.

One way to improve decanting is using an automated decanting process. While some automated processes exist, there are still challenges to automated decanting that need to be addressed. For example, with automated decanting it is sometimes difficult to separate the product inside of a container from the container. This may occur when a product within a container closely fits, matches, or corresponds to the shape and/or volume of the container. The product can be in multiple boxes that fill the volume of the container. The product could also be placed within a bag that consumes the volume of the container. As noted above, with automated decanting, separating these form-fitting products from their containers can be challenging. As such, an improved automated decanting process for separating these types of products and others from their container, such as a shipping container, would be beneficial to the industry.

Accordingly, the disclosure provides an automated process, apparatus and system for decanting containers wherein the form of the container is altered during the decanting process. A container is an object that can hold one or more products and can be used to ship or transport the one or more products. The container can be made from a variety of durable materials, such as wood, metal, plastic, and non-durable, such as corrugated fiberboard, paperboard, and cardboard. A container has a three dimensional shape and typically a flat bottom that allows transporting on a conveyor or other transport system and stacking or nesting. A container can be, for example, a rectangular prism having flat, parallel, rectangular sides or side walls, a top, and a bottom. A container can have a separate lid or one or more flaps that are used to enclose the one or more products. A fastener such as an adhesive, glue, or tape can be used to secure the lid or flaps. A box is an example of a container and will be used in parts of the disclosure as a non-limiting example of a container. Additionally, a container can include multiples of the same product or even different products. Discussion herein may use a single product within a container as an example but the discussion is applicable to more than one product and to different products.

The automated decanting process includes receiving containers, cutting the containers along a cut line that is proximate the top of the container, lifting and rotating the container after the cut such that top of the container is facing downward, and assisting in separating product from the containers by altering the form of the containers. The one or more products are located within a volume or void defined by the side walls, top, and bottom of the containers. Altering the form of the containers for the separation or removal of the product from the containers can be a pushing or a pulling motion, or a pushing and pulling motion, on one or more sides of the container. Separating the product can also include shaking the container. The automated decanting process can further include preparing the top of the containers for removal of the one or more products. The preparing, or prepping, can be after the cutting and before the lifting and rotating. For example, prepping can include releasing the top of the containers after being cut, which assists in separating the products from the containers. The preparing of the lid may also include the removal of the lid from the container.

The bottoms of the containers sit or rest on a surface for the cutting and, when included, the prepping. The containers can be located on a stationary surface or on one or more moving surfaces that transport the containers through the different stages of the automated decanting process. The moving surfaces can be a transport system, such as a conveyor, and can be manually or automatically operated. The transport systems can include a plurality of rollers connected between side rails or other types of transport or conveyor systems known in the industry. The transport systems can be an automated system that includes self-automated rollers. The operation of the rollers can be separated into independently operable zones. Each of the different stages or modules of the automated decanting process or system can have a surface that abuts to a surface of another stage. For example, a conveyor for a container cutting module, such as a cutting tool, can abut to a conveyor proximate a depositing device. The conveyors for the different stages can be independently controlled but coordinated to move containers from one stage to another. One or more of the conveyors disclosed herein can be cleated conveyors. One or more of the transport systems can be a conveyor system that is a 24-volt, zero pressure accumulation conveyor, such as available from Cornerstone Automation Systems, LLC in Frisco, Texas.

The decanted products can be deposited on a surface when separated from the containers for additional processing. The surface can be the same surface (e.g., first surface) from which the container was lifted. The decanted products can also be deposited on one or more different surfaces for additional processing. The different surfaces can be at a different height than the first surface. For example, one or more of the different surfaces can be lower or higher than the first surface. Another container can be positioned on the different surface(s) and receive the decanted products. The different receiving surfaces can be other transport systems. Depending on the surface, the deposited products can be manually or automatically moved to a product processing area for additional processing as noted below.

The automated decanting process can further include discarding the containers after the removal of the product. The containers can be discarded on various surfaces including a transport system, the floor, or a trash bin. The discarded containers can be manually removed after discarding or automatically moved away, such as by an automated transport system.

At least a part of the automated decanting process can be performed by an automated decanting system (or simply an automated decanter), such as illustrated in FIG. 1. For example, the automated decanting process of FIG. 2 can be performed by the automated decanter 100 of FIG. 1. Automated decanter 100 includes a cutting tool 110, a container prepping device 120, and a depositing device 130. The automated decanter 100 can further include a transport system 140, such as an automated transport system as noted above. The automated decanter 100 can also include at least one controller, represented by controller 150, which includes one or more processors that direct the operation of the automated decanter 100.

The automated decanter 100 can also include various types of sensors that can be used with the controller 150 to direct operation of the automated decanter 100. For example, lasers, cameras, scanners, etc. can be used to track movement of the containers on the transport system 140 through different stages of the decanting process and indicate completion of a stage and/or when a stage can be initiated. A combination of different sensors can be used with the controller 150. Stopping rails can also be used to position the containers within one or more of the various stages of decanting. The stopping rails can be a plate that pops up between the rollers of the transport system 140 when the containers are travelling along the transport system 140. The containers bump up against the stopping rail and the transport system 140 is stopped. The stopping rails can be lowered or raised by an actuator, such as a solenoid or hydraulic cylinder, driven by the controller 150. For example, the controller 150 can operate a stopping rail to stop a container for lifting and rotating by the depositing device 130. The automated decanter 100 can also include other rails that are operated by the controller and used to position or move the containers on the transport system 140 to align the containers for processing by the cutting tool 110, prepping device 120, and/or depositing device 130. Sensors/positioners 160 in FIG. 1 represents the various sensors and positioning devices of the automated decanter 100 that communicate with the controller 150 to direct operation thereof.

The cutting tool 110 can be used to perform the cutting of the containers, which can be of different sizes. The cutting tool 100 can cut along a cut line according to a cutting pattern determined by the controller 150. The cut line can be along a tape line that corresponds to tape or another adhesive that is used to secure the top of the container. The top can be in multiple pieces, such as flaps, that are taped together to enclose the product(s) within the container. Cutting along the cut line can release the flaps or the top such that product can be removed from the container when the container is rotated upside down (top is rotated to the bottom and the bottom is rotated to the top such that gravity assists in releasing the product from the void of the container). The cut line can be along one or multiple side walls or seams between a side wall and the top. The cutting tool can be or use a robotic device, such as mounted on a robotic arm. The cutting tool 110 can be an intelligent box opening device (IBOD) available from Cornerstone Automation Systems, LLC of Frisco, Texas. The IBOD is described in U.S. Pat.

Nos. 7,720,567 and 8,463,428, which are incorporated herein by reference. Other programmable cutting tools can also be used. Manually cutting containers can also be used with the automated decanting disclosed herein. A user can manually cut the container and also manually remove the cut portion, such as with a four-sided cut.

The container prepping device 120 prepares the container for decanting of the product. The container prepping device 120, for example, can be constructed to separate portions of the container along the cut line. For example, with a tape cut that releases the top of containers, the container prepping device 120 can be used to pop open the flaps of the top to ensure that the container's top flaps are fully released from tape. As such, the operation or even presence of the container prepping device 120 can depend on the type of cut performed by the cutting tool 110. For example, the container prepping device 120 may be a device which aides in the instance in which the type of cut performed cuts all side walls of the container. This container prepping device 120 grabs the lid of the box using suction cups, and removes it from the body of the container. This lid may then be dropped onto another surface to separate the lid from the remaining container with an open top. The automated decanter 100 can include the container prepping device 120 and activate it based on need, such as the type of cut. The controller 150 can determine when to activate the container prepping device 120 via communications with the cutting tool 110.

The depositing device 130 is constructed to separate products from the containers by, for example, lifting a container, turning the container over, and while the opened end of the container is facing downward, contracting and/or expanding side walls of the container. The depositing device 130 can also shake the container, such as move the container up and down, back and forth, or both, to assist in removing the product from the container. The depositing device 130 may also push and pull on the bottom surface of the container to aid in removing product therefrom. All of the contraction, expansion, shaking, moving, pushing, and pulling on the container may be done at the same time or in sequence to maximize the likelihood of successfully removing the product from the container using gravity.

The depositing device 130 includes a programmable motion device (PMD) and lifting arms connected to the PMD that cooperate to separate the products from the containers. The PMD can be a commercially available robot, a Computerized Numerical Control (CNC) machine, fixed automation, or a custom-built device. The PMD can be a Selective Compliance Assembly Robot Arm (SCARA), an articulated robot, a cobot, or another type of robot. The PMD can have a body positioned on a base and a support arm, such as a jointed arm with multiple sections, which are connected to the base. The lifting arms can be attached to the support arm via, for example, a plate that allows movement of the lifting arms. The depositing device 130 can be, for example, depositing device 440 illustrated in FIGS. 4 and 6.

The transport system 140 provides a surface for the containers as the containers are moved through the various stages of the automated decanter 100. As such, the transport system 140 is positioned and constructed to manually (i.e., manual system) or automatically (i.e., an automated system) move containers through the various stages of the automated decanter 100. The transport system 140 can be a single apparatus that extends through each of the different stages of the automated decanter 100. The transport system 140 can also be constructed of multiple transport systems that abut each other and extend through one or more of the different stages. For example, the cutting tool 110, container prepping device 120, and depositing device 130 each include their own transport system 142, 144, 146, that collectively form the transport system 140. An automated transport system or a portion thereof can be controlled by the controller 150.

The transport system 140 may rest on and be attached to the floor where the automated decanter 100 is located. The automated decanter 100 can also include a frame, which can support the transport system 140. The frame (not shown in FIG. 1) can be constructed from various materials such as metal and protect operators from contact with the containers and the various tools and/or devices of the automated decanter 100, such as the PMD. For example, the frame can include protective glass, shields, screens, safety sensors, interlocks, emergency stops, etc. to protect operators. The frame can also support one or more of the cutting tool 110, container prepping device 120, and depositing device 130. For example, the PMD of the depositing device 130 can be positioned on the frame. Alternatively, the base of the PMD can rest on and be attached to the floor where the automated decanter 100 is located. The frame can also support the controller 150.

The controller 150 can include one or more processors, memory, and user interface. The controller 150, for example, can include a RAM, a hard drive, a monitor, keyboard, mouse, speakers, and a conventional operation system. The one or more processors of the controller 150 direct the operation of the automated decanter 100 according to a series of operating instructions that correspond to one or more algorithms directed to automatically decant products from containers. The series of operating instructions can be stored on the one or more memories, which can be a non-transitory computer readable medium. An example of a controller is provided in FIG. 3. The controller 150 can be, for example, a computer, a laptop, a PLC, a circuit board, a drive card, or a robot controller. The automated decanter 100 can include more than one controller. As such, the functionality of the controller 150 can be distributed.

In some examples, the controller 150 can be communicatively coupled to a central controller of a product processing system and the central controller can include logic to perform some of the functionality of the controller of the automated decanter 100. The product processing system can be in a fulfillment center, such as an e-commerce fulfillment center, a warehouse, storage facility, etc.

The automated decanter 100 can be part of a product processing system that receives containers, automatically decants the containers, and further processes products from the containers after decanting. In some examples, the controller 150 can be communicatively coupled to a central controller of the product processing system and the central controller can include logic to perform some of the functionality of the controller 150 of the automated decanter 100. The product processing system can be in a fulfillment center, such as an e-commerce fulfillment center, a warehouse, storage facility, etc. A transport system, such as an automated transport system, can connect the automated decanter 100 to a processing area for additional processing. For example, the transport system 140 can be extended or another transport system can be used to move decanted products from automated decanter 100 to the processing area for additional processing.

The additional processing can include loading the decanted products into other containers for storing in a storage system, such as an ASRS. The original containers can be shipping containers and the containers for storage can be storage containers. The storage containers can be part of the ASRS. The product processing station can also include a quality control station or inspection station. The product processing station can also include a shipping station where the decanted products are placed in other containers for shipping. The additional processing could also include distributing the decanted products for retail, such as placing the products on shelves of a store.

Figure 2:
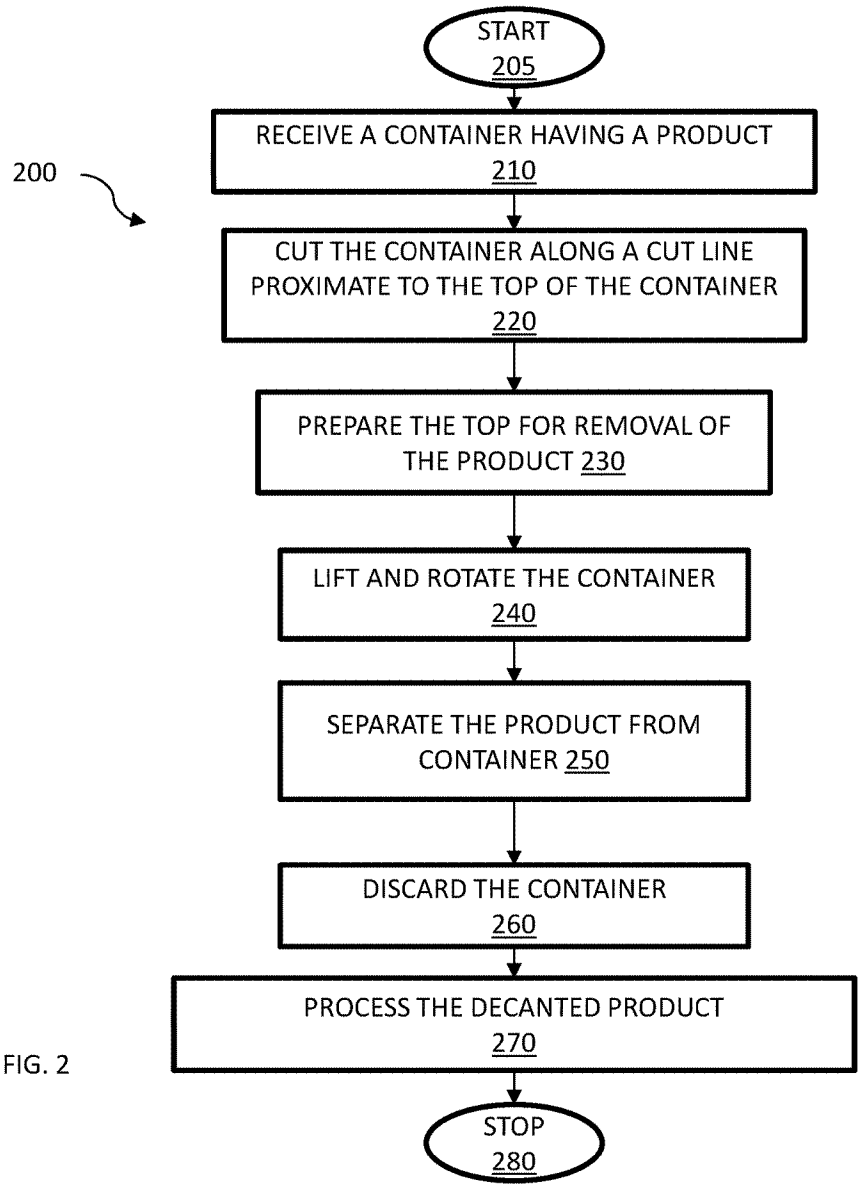
FIG. 2 illustrates a flow diagram of an example of a method 200 of an automated decanting process carried out according to the principles of the disclosure.

FIG. 2 illustrates a flow diagram of an example of a method 200 of an automated decanting process carried out according to the principles of the disclosure. Each of the steps can be considered stages of the decanting process and one or more transport systems, such as an automated transport system, can move a container to each of the stages. At least a portion of the method 200 can be carried out using an apparatus or system, such as an automated decanter as disclosed herein. The automated decanter can include a controller having one or more processors that direct the operation thereof according to a series of operating instructions that correspond to one or more algorithms directed to automatically decanting products from containers. The series of operating instructions can be stored on a non-transitory computer readable medium. An example of a controller is provided in FIGS. 1 and 3 and FIGS. 4 to 6 illustrate examples of at least portions of an automated decanter that can be used to perform one or more stages of the automated decanting method 200. The below discussion of method 200 refer to FIGS. 4 to 6 as examples. Some of the steps of the method 200 may be in a different order and some of the steps of the method 200 may be omitted, such as step 230. The method 200 can be repeated multiple times for multiple containers. The method 200 begins in step 205.

Figure 4:
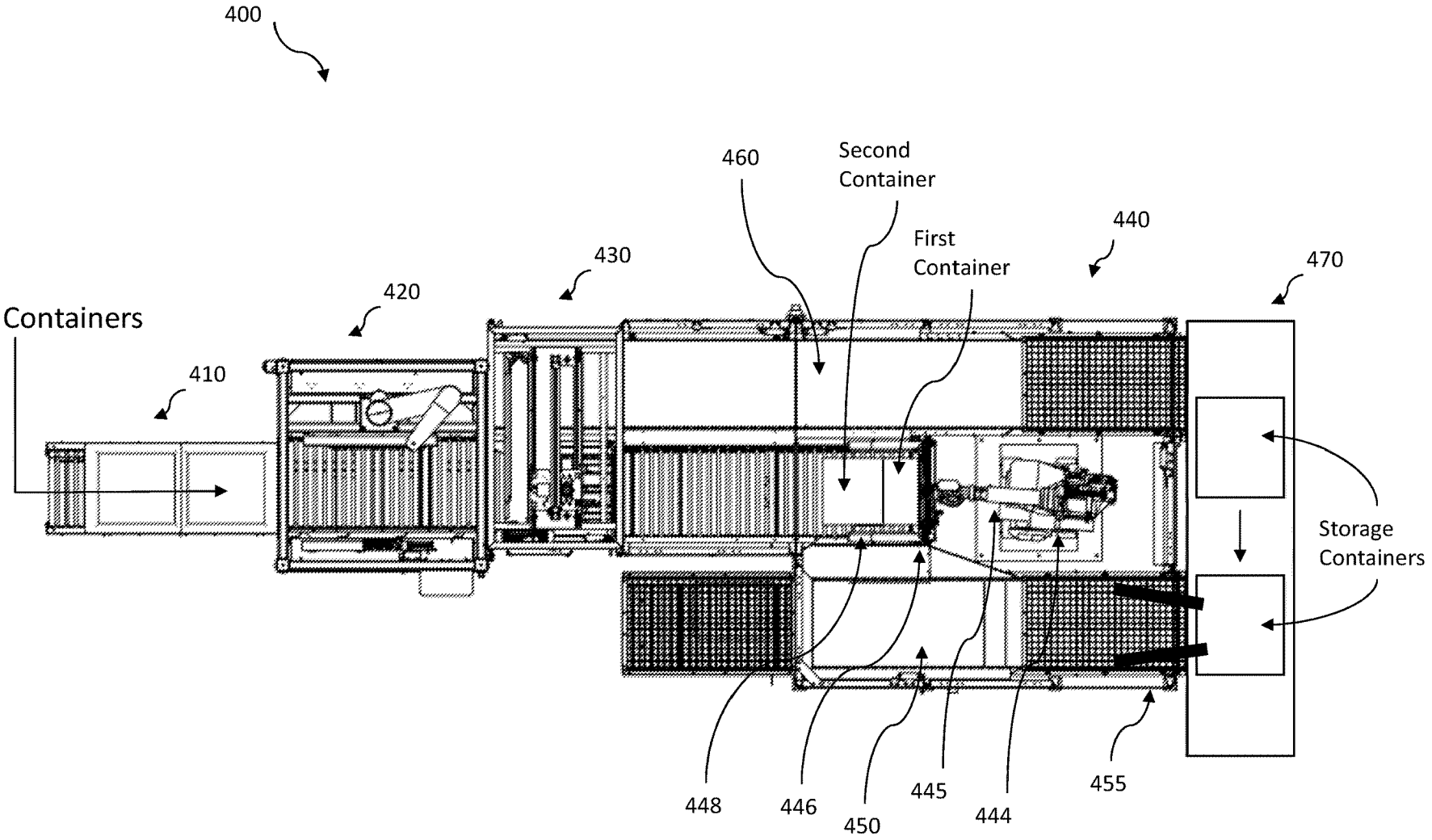
FIG. 4 illustrates a top view of an example of an automated decanter constructed according to the principles of the disclosure.

In step 210, a container having a product is received. The container can have one or more products. The container can be received via a transport system, such as a conveyor. FIG. 4 illustrates a top view of an example of an automated decanter 400 having a conveyor 410 for receiving containers.

In step 220, the container is cut along a cut line on at least one wall of the container. The cut line is proximate the top of the container, such as within two inches of the top of the container. The cut line can correspond to a tape line. FIG. 4 illustrates an example of a cutting tool 420 as part of automated decanter 400. The cutting tool 420 can be cutting tool 110 as illustrated in FIG. 1. It is appreciated that a number of cut configurations could be used in step 220, such as tape cuts, 3-sided cuts, 4-sided cuts, plunge cuts, and window cuts.

Figure 5A:
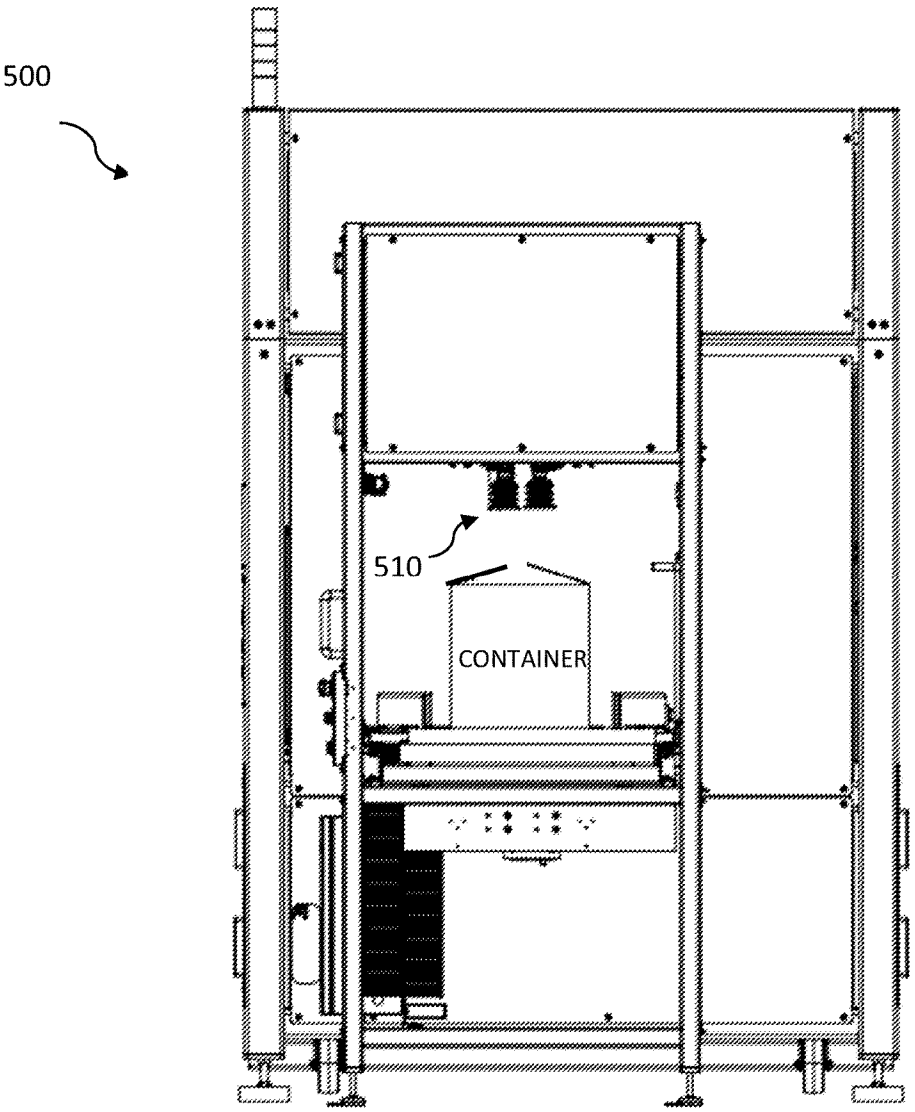
FIGS. 5A and 5B illustrate examples of a container prepping device having grippers and being used for popping a lid and removing a lid.
Figure 5B:
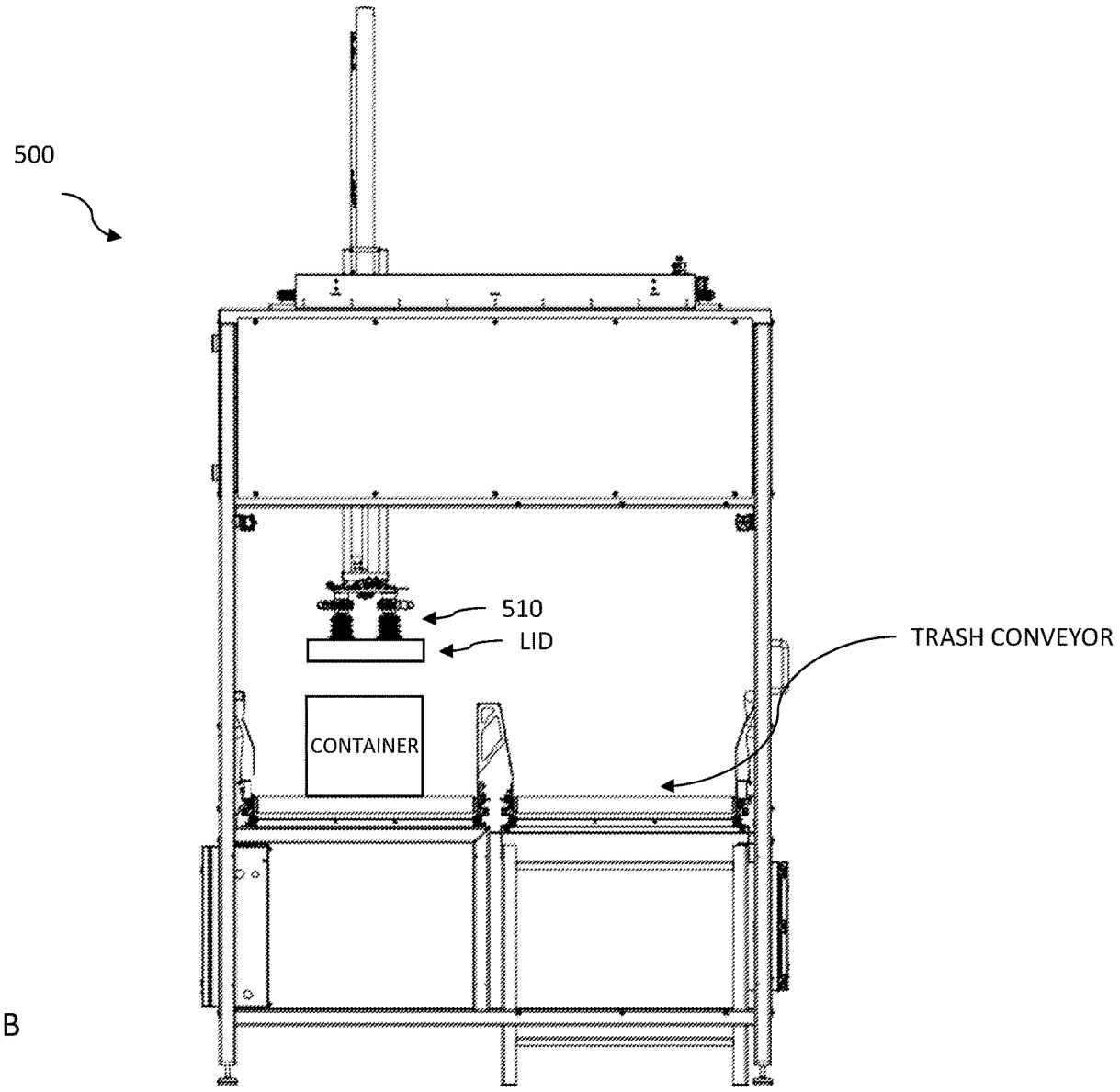

The container is prepared for removing the product in step 230. A container prepping device can lift, such as via suction, the top of the container to prepare the container for decanting. Pneumatic grippers can be used to ensure that the top flaps of the container can fully open. FIG. 4 illustrates the positioning of container prepping device 430 after the cutting tool 420. FIG. 5A illustrates an example of container prepping device 500 having grippers 510. FIG. 5A provides a visual example of the condition of the top of a container after the top flaps are lifted-up by grippers 510. The container top can be in more than one piece as illustrated. In FIG. 5A, a cut line corresponding to a tape line was used to cut the. When the cutting in step 220 includes cutting all of the side walls of the container proximate the top of the container, step 230 may be used to remove the lid from the container leaving the container with four side walls and a bottom surface. The removed lid can then be discarded. As such, the grippers 510 can be used to lift and discard the lid. The removed lid can be discarded similarly to how a container is discarded in step 260. FIG. 5B illustrates the grippers 510 of the container prepping device 500 being used to remove the lid, which can then be discarded on the trash conveyor. When the cutting in step 220 includes cutting at least one side wall of the container, such as two or three, but less than all of the side walls of the container proximate the top of the container, step 230 may be omitted and the method 200 moves directly to step 240 after step 220.

Figure 6:
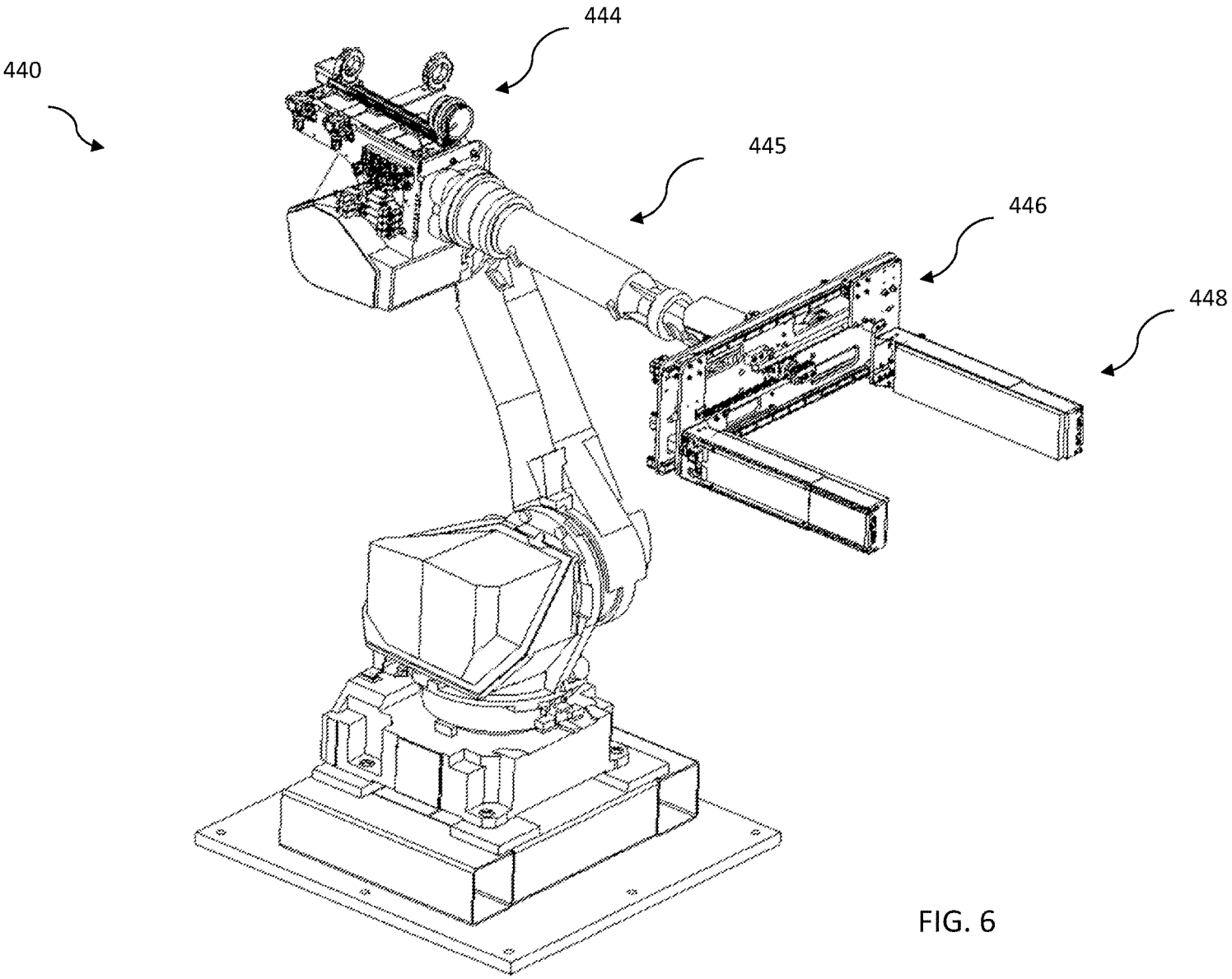
FIG. 6 illustrates a view of the depositing device in the automated decanter of FIG. 4.

In step 240, the container is lifted and rotated. A depositing device, such as depositing device 440 of FIG. 4 can be used for the lifting and rotating. The depositing device 440 of automated decanter 400 in FIG. 4 includes a PMD 444, a plate 446, and lifting arms 448 attached to the PMD 444 via the plate 446. The lifting arms 448 are used to grab, lift, and rotate one or more containers such that the top of the containers are tilted to allow the product to fall out of the container via gravity. A non-fragile item could be dumped out very quickly by just turning the container upside down. But for products that need a more gentle removal, the lifting arms 448 can be used to tilt and move the container at a shallow angle, but still a sufficient angle for product to fall out of the box, as close to surface where the product will be deposited. Usually one container will be lifted and rotated at a time during step 240. However, in some cases, more than one container may be lifted and rotated at the same time, such as shown in FIG. 4. FIG. 6 illustrates another view of the depositing device 440.

Figure 7:
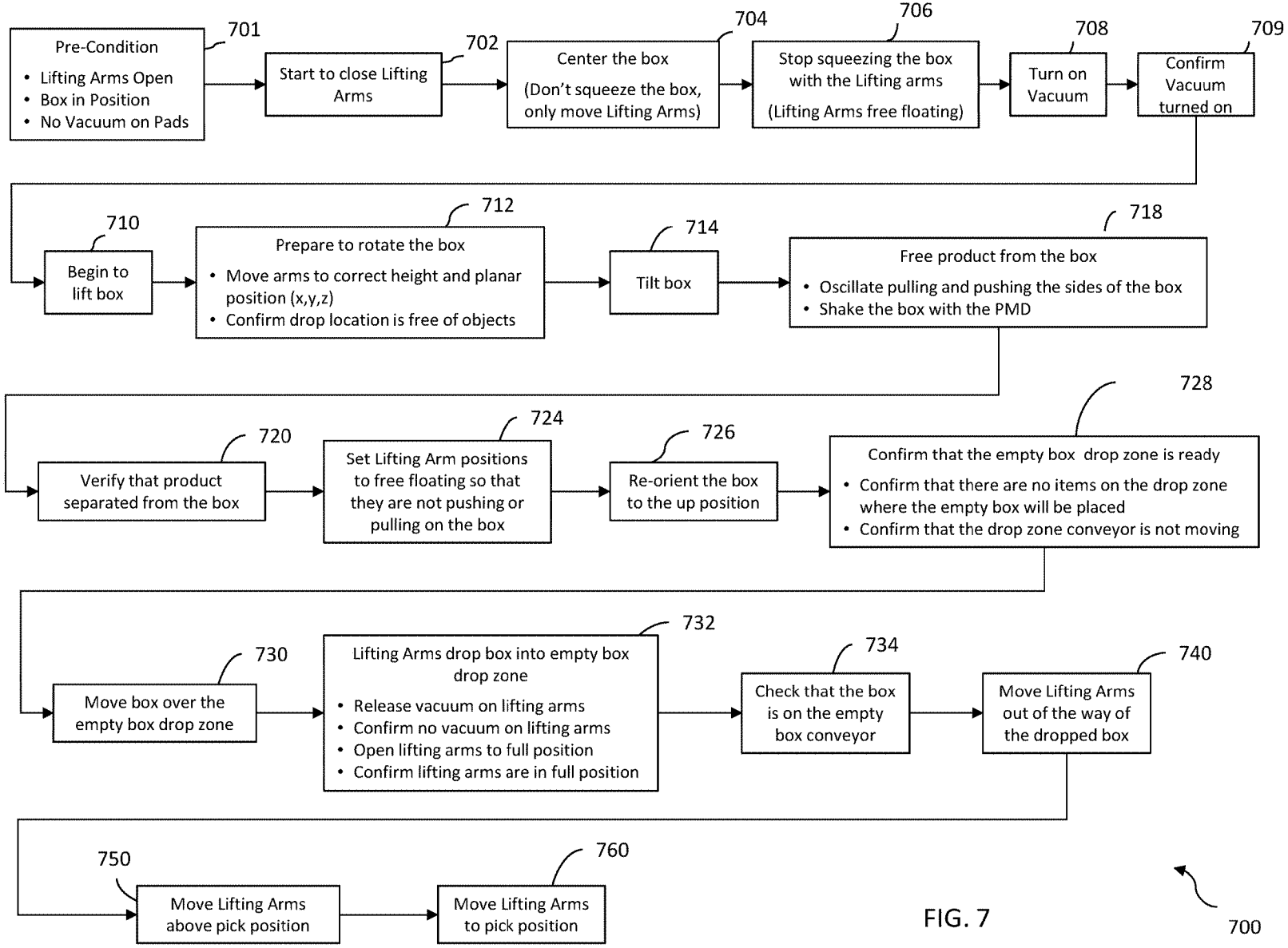
FIG. 7 illustrates an example of a method of operating a depositing device such as illustrated in FIG. 4.

The product is separated from the container in step 250. In addition to the use of gravity, the product can be separated by altering the form of the container, such as by expanding and/or contracting (pushing or pulling) one or more side walls or the bottom surface of the one or more containers using the lifting arms. For example, one or more of the lifting arms 448 can be moved in bursts or pulses along the length of the plate 446 for the pushing and pulling. The lifting arms could also include grippers for the expanding. A lifting arm can also be used on the bottom of the container, and the bottom can be expanded/contracted in addition to or instead of one of the side walls. The lifting arms 448 may vary the force, speed, duration, and direction of the pushing and pulling on the container using air pressure or other know methods in the art. The container can also be shaken in one or more directions by the PMD 444 to assist in the separating. The shaking motion can be in unison with the altering or at least partially simultaneous with the altering. The shaking and altering can also occur separately. The controller can direct the operation of the depositing device 440. FIG. 7 provides an example method 700 of operation depositing device 440. The separated product can be deposited on a transport system, such as transport system 450 of the automated decanter 400.

The container is discarded in step 260. The container can be discarded onto a transport system that can be an automated transport system to automatically remove the discarded container. The container can also be discarded on a table or the floor for manual removal. Alternatively, the container can be discarded directly into a trash bin. The PMD 444 and the lifting arms 448 of automated decanter 400 can discard the containers on, for example, transport system 460, which can then be removed, for example, before reaching the product processing area 470. The containers could also be discarded on another transport system not shown and both of the transport systems 450 and 460 of automated decanter 400, can be used for receiving decanted products. FIG. 5B illustrates an example of a trash conveyor that can be used for receiving removed lids of containers and also discarded containers. One skilled in the art appreciates that the discarded container could be placed at the same location or on the same transport system as the product separated from the container.

Method 200 continues to step 270 where the decanted product is further processed. For example, the decanted product can be manually or automatically delivered to a product processing area. FIG. 4 shows an example of automatically delivering decanted product via at least transport system 450 (and possibly transport system 460) to a product processing area 470 where the product can be placed in storage containers. The storage containers can be part of an ASRS. Product funnels 455 can be used to assist moving the decanted products to the product processing area 470. Method 200 continues to step 280 and ends. As noted above, method 200 can be repeated multiple times for various containers.

Figure 3:
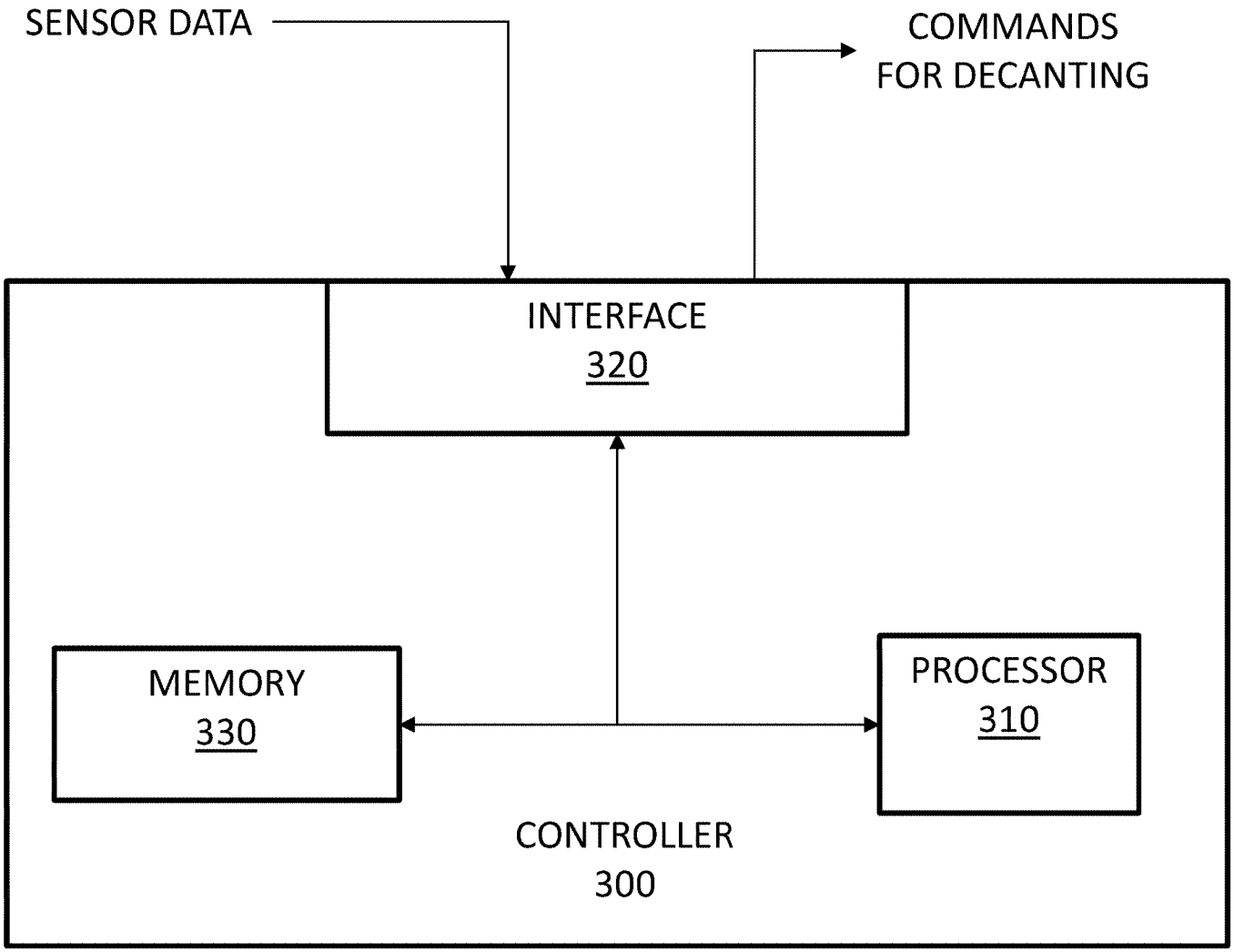
FIG. 3 illustrates a block diagram of an example of a controller 300 constructed according to the principals of the disclosure.

FIG. 3 illustrates a block diagram of an example of a controller 300 constructed according to the principals of the disclosure. The controller 300 includes one or more processors, represented by processor 310, which are configured to direct the operation of the controller 300 to control the operation of an automated decanter or decanting system. The processor 310 may be a conventional processor such as a microprocessor. Additionally, the controller 300 includes one or more interface, represented by interface 320 and one or more memory, represented by memory 330, coupled thereto. The components of the controller 300 can be coupled together by and communicate via typical means used in the industry, such as conventional connections and communication protocols. One skilled in the art will understand that the controller 300 can include additional components typically included with a controller such as a power supply or power port.

The interface 320 includes multiple ports for transmitting commands and receiving data from at least the sensors of the automated decanter, such as from the sensors/positioners 160 of FIG. 1. The interface 320 can support wireless or wired communications. Additionally, the interface 320 can receive programming instructions to direct the operation of the automated decanter. The programming instructions can be code representing algorithms that, for example, correspond to the method 200. The programming instructions can be encrypted for security.

The commands can direct an automated transport system to move containers to different stages of an automated decanting process and control the stages. The stages correspond to, for example, the cutting tool 110, the prepping mechanism 120, and the depositing device 130, and to one or more of the steps of method 200. For example, the commands can be in response to received sensor data that indicates a container is in position to be cut and then when the cut container is ready to be rotated. Sensor data can also indicate when to separate the product from the container and when to discard the container.

The programming instructions can also be code representing algorithms that correspond to the method 700 of FIG. 7. Method 700 provides additional details of operating a depositing device for automated decanting. As with method 200, various sensors can be used to confirm and direct operations of the method 700. For example, vacuum sensors, cameras, lasers, etc. may provide inputs for monitoring the method 700.

The memory 330 is constructed to store data and computer programs. The memory 330 can be a conventional memory. The memory 330 may be a non-transitory computer readable medium that stores operating instructions, such as the programming instructions, to direct the operation of the processor 310 when initiated thereby. The operating instructions may correspond to algorithms that provide the functionality of the operating schemes disclosed herein. The memory 330, therefore, stores the programming instructions that direct the operation of an automated decanter, such as disclosed herein. The processor 310 can also generate commands to work with other components of a product processing system. The commands can correspond to one or more steps of method 200 or method 700.

FIG. 6 illustrates a diagram of depositing device 440 that is constructed according to the principles of the disclosure. The depositing device 440 is a robotic depositing device that includes the PMD 444, a support arm 445, the plate 446, and the lifting arms 448.

As noted above, the lifting arms 448 are connected to PMD 444 via the plate 446 and the plate 446 is connected to the PMD 444 via the support arm 445. The PMD plate 446 may be configured to cause the lifting arms 448 to move back and forth in at least one plane so that they can grip one or more containers. In the following discussion, one container is used as an example. The lifting arms 448 can move at the same time, causing a container to slide into a position centered on the plate 446. The plate 446 can also be configured so that one of the lifting arms 448 remains stationary while the other one of the lifting arms 448 moves to contact the container. The lifting arms 448 may consist of vacuum cups, large area vacuum grippers, or other grippers which can be used to connect to the side of the container. The grippers should be sufficiently long and wide enough be able to keep containers from falling out of the lifting arms 448 even while altering the form of the container and shaking the container. The lifting arms 448 may grip the container near the top of the container, for greater ability to alter the form of the container near the top, near the bottom of the container for altering the form of the container near the bottom, or somewhere between the top and bottom of the container to optimize altering the form of the container. It can be appreciated that unique combinations of containers and product types may need a different positional grip with the lifting arms 448. Not indicated in the figures, a third lifting arm may be present which will hold the bottom of the box. The third lifting arm may move in a direction perpendicular to the lifting arms 448. More than one lifting arm could be used on a single side wall or on the bottom of the container. This one or more arm could be used to push and/or pull on the side wall or bottom surface of the container.

The PMD 444 is operated to lift the container and rotate the container via the support arm 445 and in cooperation with the plate 446 and the lifting arms 448, such that the top of the container is facing in a direction so that the product falls out of the container. This direction may be downward. This direction may be to the side but with an angle to allow product to slide down the side wall of the container and out of the open end of the container. The container can be rotated in a range of 90 to 200 degrees. For example, the rotation can be 180 degrees. During rotation of the container, the PMD 444 may slowly rotate the container to allow product inside of the container to fall out of the container one at a time. Additionally, as product is falling out of the container, the PMD 444 may translate along the depositing surface, such as transport system 450, so that the product can be evenly distributed along the surface. Such translating can be beneficial when an additional container, such as a storage container, is present on the depositing surface to be filled with the decanted product. In some cases, it may be beneficial to disengage one or more lifting arms 448 from the box. For example, in order to bring a container very close to the transport system 450, the lifting arms 448 may need to be separated from one another to prevent interference with parts of the depositing device 440. In this scenario, one of the lifting arms 448 would loosen its grip on the container while the other lifting arm 448 maintains its grip and then the lift arms 448 would move apart. PMD 444 would then rotate the container to allow the product to fall out of the container while it is close to the transport system 450.

FIG. 7 illustrates a flow diagram of an example method 700 of operating a depositing device according to the principles of the disclosure. The method 700 represents a series of operating instructions that correspond to one or more algorithms directed to operating a decanting device for automatically decanting products from containers. In method 700, a box is used as an example of a container. The series of operating instructions can be stored on a non-transitory computer readable medium. The depositing device can be, for example, depositing device 440 of FIGS. 4 and 6 having vacuum pads on the lifting arms. The method begins in step 701 with a pre-condition that the lifting arms of the depositing device are open, the box is in position for lifting and rotating, and there is no vacuum on the vacuum pads of the lifting arms.

In step 702, closing of the lifting arms around the box is initiated. In step 704, the box is contacted by the lifting arms and centered. The box can be centered on the plate upon which the lifting arms are connected. In step 704, the box is not squeezed for lifting.

In step 706, engagement with the lifting arms is stopped. As such, the lifting arms can free float. The vacuum is then turned-on in step 708 and confirmed in step 709. With the vacuum turned-on, the vacuum pads of the lifting arms are holding the box.

After confirmation of the vacuum, the box is lifted in step 710. The PMD lifts the box via the support arm and plate while the box is being held by the vacuum pads of the lifting arms. After lifting, preparation for rotating the box is made in step 712. The preparations include moving the lifting arms to the desired height and planar position for rotating. The preparations can also ensure that the drop location for the product, such as a transport system, is free from objects. In step 714, the box is rotated by the depositing device. The PMD can rotate the support arm to cause a desired rotation of the box that is supported by the lifting arms. The box can be rotated at different speeds according to, for example, user preferences or historical data. The box can be rotated in a range of 90 to 200 degrees. For example, the rotation can be 180 degrees.

In step 718, product is separated from the box by the depositing device. The depositing device can free the product by altering the box form using the vacuum pads to expand at least one side wall of the box, contract at least one sidewall of the box, or both. The lifting arms and vacuum pads can oscillate between pushing and pulling the sidewalls. The force used to push and pull can vary, such as based on the difficulty in removing the product. The difficulty in removing can be due to one or a combination of several factors, such as the similarity in size between the product and the volume of the box, the material of the box, the type of packaging for the product, etc. The depositing device can also free the product by shaking the box after the lifting and rotating. The shaking can be done alongside the altering of the box form.

In step 720, verification of the release of the product from the box is made. Verification can be made by various sensors or methods and can be made by a combination of sensors and/or methods. For example, a camera can be used to verify the product was deposited on a conveyor, a torque value of the PMD can monitored to detect a change, etc.

Once verification of depositing of the product, the positon of the lifting arms is set at free floating in step 724. As such, altering of the box form is no longer possible. The box is then reoriented to the up position in step 726. Accordingly, the open end of the box is returned to face upward. In step 728, confirmation that a drop zone is ready for receiving the empty box is made. The drop zone can be various surfaces including a transport system, the floor, or a trash bin. If an automated transport system, the confirmation can include that the automated transport system is not moving.

The empty box is then moved over the drop zone in step 730. In step 732, the box is discarded. The box can be discarded by releasing the vacuum and opening the lifting arms away from the box, such as in a full open position, to allow the box to drop. A confirmation of the release of the vacuum and opening of the arms can be made via various sensors. Confirmation that the box has been discarded is made in step 734. A sensor, such as a camera, can be used to verify the empty box is on, for example, a trash conveyor.

The depositing device is then moved away from the drop zone in step 740. For example, the PMD can move the plate and lifting arms via the support arm. The depositing device can be relocated to a position above a box pick position in step 750. The box pick position can be on a transport system where the next box will be delivered. This pick position could be the same position that the depositing device was located in during step 701. In step 760, the lifting arms are positioned in the pick position wherein the next box is received and method 700 can be repeated.

Figure 8:
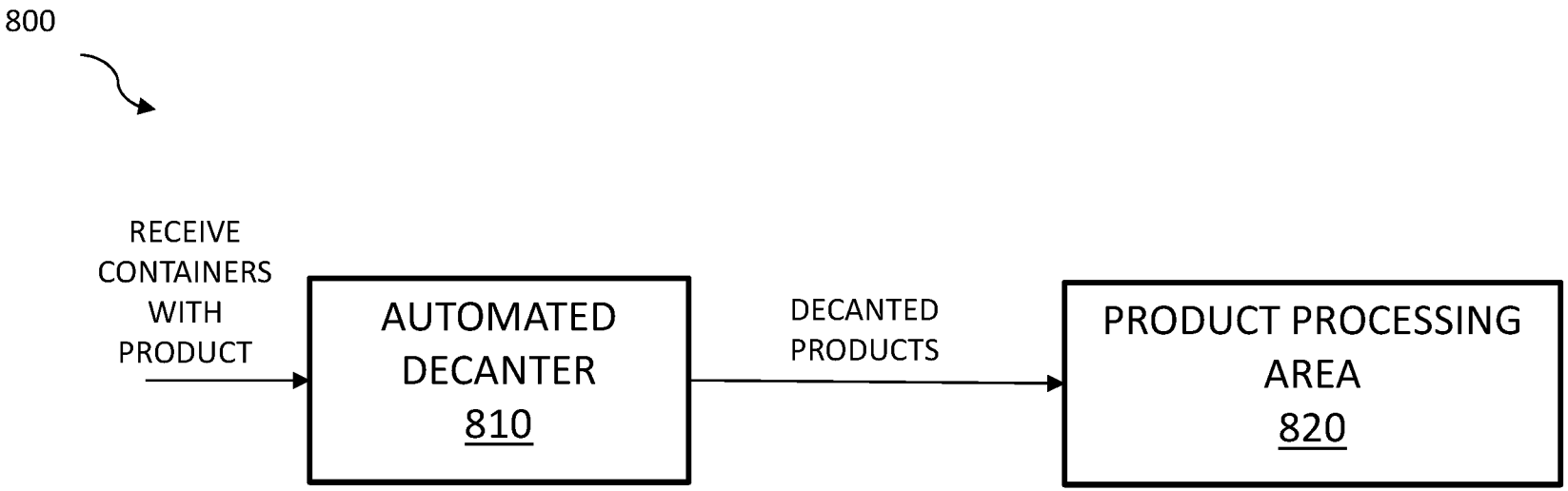
FIG. 8 illustrates a product processing system for receiving, decanting, and processing containers having products according to the principles of the disclosure.

FIG. 8 illustrates a product processing system 800 for receiving, decanting, and processing containers having products according to the principles of the disclosure. The product processing system 800 includes an automated decanter 810 and at least one product processing station 820. The automated decanter 810 can be, for example, automated decanter 100 or 400 as disclosed herein. The product processing station 820 can include, for example, one or more shipping stations, one or more storage systems, and/or one or more quality control stations. The product processing station 820 can be the product processing station 470. In some examples, decanted products from the automated decanter 810 can be automatically decanted into storage containers, such as storage containers for an ASRS. In another example, decanted products from the automated decanter 810 could be transported into storage containers, such as storage containers for an ASRS, using a mixture of automated and manual methods. The automated decanter 810 and the product processing station 820 can be connected via a transport system, such as an automated conveyor.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). For example, a programmable logic controller or an Industrial Computer Processor. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Configured or configured to means, for example, designed, constructed, or programmed, with the necessary logic and/or features for performing a task or tasks. A configured device, therefore, is capable of performing the task or tasks. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the example methods and materials are described herein. Each of the below example independent claims may include one or more of the features of the dependent claims in combination.

What is claimed is:

1. An automated decanter, comprising:

lifting arms configured to separate one or more products from at least one box, by altering a form of the at least one box through expansion and contraction of at least one wall of the at least one box, wherein the altering is performed by the lifting arms while holding the box.

2. The automated decanter as recited in claim 1, wherein the at least one box is a cardboard box.

3. The automated decanter as recited in claim 2, wherein the one or more products fit a shape and a volume of the cardboard box.

4. The automated decanter as recited in claim 1, wherein the at least one wall is a sidewall of the box.

5. The automated decanter as recited in claim 1, wherein the one or more products are deposited on one or more surfaces after being separated from the box.

6. The automated decanter as recited in claim 5, wherein at least one of the one or more surfaces is a conveyor.

7. The automated decanter as recited in claim 1, wherein the lifting arms are further configured to lift and rotate the box prior to the altering.

8. The automated decanter as recited in claim 1, further comprising a cutting tool configured to cut the at least one box along a cut line before the altering, wherein the box has a bottom, a top, and multiple side walls between the bottom and the top, and the cut line is proximate the top.

9. The automated decanter as recited in claim 8, wherein the cut line is along at least three of the side walls.

10. The automated decanter as recited in claim 8, wherein the cut line is along a tape line.

11. The automated decanter as recited in claim 8, wherein the cut line is along each of the multiple side walls.

12. The automated decanter as recited in claim 8, wherein top remains connected to the at least one of the multiple side walls after the cut.

13. The automated decanter as recited in claim 8, further comprising a container prepping device that prepares or removes the top of the box to aid in separating the one or more products from the box after the cut and before the altering.

14. The automated decanter as recited in claim 1, wherein the lifting arms are further configured to discard the box after the separating of the one or more products.

15. The automated decanter as recited in claim 1, further comprising a cutting tool, a controller, and one or more transport systems, wherein the controller is configured to direct operation of one or more of the cutting tool, the lifting arms, and the one or more transport systems.

16. The automated decanter as recited in claim 15, wherein the lifting arms are further configured to separate the one or more products from the at least one box by shaking the at least one box in addition to the altering.

17. The automated decanter as recited in claim 1, wherein the lifting arms are connected to a support arm of a programmable motion device, and the lifting arms cooperate with the programmable motion device for the altering.

18. A product processing system, comprising:

an automated transport system; and an automated decanter that receives boxes from the automated transport system and includes:

a cutting tool configured to cut the boxes along a cut line proximate a top of the boxes; and a depositing device having:

lifting arms configured to separate one or more products from at least one of the boxes by expanding and contracting at least one wall of the at least one of the boxes and by holding and simultaneously shaking the at least one of the boxes.

19. The product processing system as recited in claim 18, wherein the automated transport system is further configured to deliver the one or more products to a product processing station, wherein the product processing station includes one or more of product processing station quality control station, product processing station storage system, or product processing station shipping station.

20. The product processing system as recited in claim 19, wherein the product processing station storage system is an automated storage and retrieval system.

21. A method of automatically decanting products from boxes, comprising:

opening a portion of a box;

lifting and rotating the box using a robotic depositing device; and separating a form-fitting product or products from the box after the lifting and rotating by shaking the box, by altering a form of the box through expansion and contraction of at least one wall of the box, or by a combination of the shaking and the altering, wherein the shaking and altering are performed by the robotic depositing device while holding the box.

22. The method as recited in claim 21, wherein the opening a portion of the box includes cutting the box along a cut line that is proximate a top of the box or is along the top of the box.

* * * * *